US008997647B2

(12) United States Patent
Dumenil

(10) Patent No.: US 8,997,647 B2
(45) Date of Patent: Apr. 7, 2015

(54) SILK SCREEN PRINTING DEVICE WITH TWO MODES OF PRINTING

(71) Applicant: François Dumenil, Chaumes en Brie (FR)

(72) Inventor: François Dumenil, Chaumes en Brie (FR)

(73) Assignee: Machines Dubuit (FR)

( * ) Notice: Subject to any disclaimer, the term of this patent is extended or adjusted under 35 U.S.C. 154(b) by 0 days.

(21) Appl. No.: 14/048,579

(22) Filed: Oct. 8, 2013

(65) Prior Publication Data

US 2014/0109780 A1 Apr. 24, 2014

(30) Foreign Application Priority Data

Oct. 19, 2012 (FR) ..... 12 60009

(51) Int. Cl.

| | |
|---|---|
| ***B05C 17/04*** | (2006.01) |
| ***B41F 15/44*** | (2006.01) |
| ***B41F 15/08*** | (2006.01) |
| ***B41F 15/14*** | (2006.01) |
| ***B41F 15/16*** | (2006.01) |
| ***B41F 15/40*** | (2006.01) |

(52) U.S. Cl.

CPC ..... *B41F 15/44* (2013.01); *B41F 15/0813* (2013.01); *B41F 15/085* (2013.01); *B41F 15/14* (2013.01); *B41F 15/16* (2013.01); *B41F 15/40* (2013.01)

(58) Field of Classification Search

CPC ..... B41F 15/0818; B41F 15/0827; B41F 15/0872; B41F 15/42; B41F 15/423

USPC ..... 101/115, 123, 124, 127.1, 129

See application file for complete search history.

(56) References Cited

U.S. PATENT DOCUMENTS

| | | | | |
|---|---|---|---|---|
| 3,943,849 | A * | 3/1976 | Vasilantone | 101/123 |
| 5,176,076 | A | 1/1993 | Azuma et al. | |
| 5,189,950 | A * | 3/1993 | Eppinger | 101/115 |
| 8,393,268 | B2 * | 3/2013 | Dubuit et al. | 101/123 |
| 8,474,376 | B2 * | 7/2013 | Dumenil | 101/123 |
| 2003/0154868 | A1 * | 8/2003 | Mcevoy et al. | 101/127.1 |

FOREIGN PATENT DOCUMENTS

FR 2 816 880 A1 1/1993

OTHER PUBLICATIONS

French Search Report dated Aug. 14, 2013 issued in corresponding French patent application No. FR 1260009.

* cited by examiner

*Primary Examiner* — Ren Yan

(74) *Attorney, Agent, or Firm* — Ostrolenk Faber LLP

(57) ABSTRACT

Device for silk screen printing on an object, comprising a screen holder module for holding a screen; and a squeegee holder module for holding a squeegee for scraping over the screen along a direction of scraping. The squeegee holder module comprises a support mounted on the chassis, and a removable squeegee holder attached to the support, the support having a receiving surface for receiving the squeegee holder, and the squeegee holder having a fastening plate for fastening the squeegee holder on the receiving surface with a scraping direction extending along a direction of printing (Ox), and an alternative fastening plate for fastening the squeegee holder in an alternative printing position with a scraping direction extending along an alternative direction of printing (Oy).

9 Claims, 6 Drawing Sheets

SILK SCREEN PRINTING DEVICE WITH TWO MODES OF PRINTING

TECHNICAL FIELD OF THE INVENTION

The present invention relates to a device for printing an impression by silk screen printing on at least one object, of the type comprising of:

a chassis, a screen holder module mounted on the chassis for holding a screen, and a squeegee holder module mounted on the chassis for holding a squeegee that is designed for scraping over the screen along a direction of scraping.

BACKGROUND OF THE INVENTION

The object on which the silk screen printing is to be performed is held by an object holder module, for example mounted on a turn table unit. The screen is normally horizontal. The squeegee scrapes the screen in a direction of printing or a longitudinal direction. The object has a rectilinear generatrix in a transverse direction perpendicular to the longitudinal direction.

In order to print on an object having a rectilinear generatrix in the longitudinal direction, it is a technique known from the state of the art to modify the configuration of the printing device in order for the squeegee to be scraping the screen in the transverse direction. For this purpose, the printing device is provided with a second squeegee holder that is capable of scraping the screen in the transverse direction which replaces the first squeegee holder that is capable of scraping the screen in the longitudinal direction.

However, the modification of the device is a long and complex process because it is necessary to readjust the position settings of the blade holder module relative to the chassis.

SUMMARY OF THE INVENTION

An object of the invention is thus to overcome the above mentioned disadvantages, that is to say, in particular to provide a device that enables a rapid change in the direction in which the scraping is being done, while at the same time preserving the position settings of the squeegee holder relative to the chassis.

To this end, the invention relates to a device for printing an impression by silk screen printing on at least one object, of the type described here above, wherein the squeegee holder module comprises a support mounted on to the chassis, and a removable squeegee holder attached on to the support, the support having a receiving surface for receiving the squeegee holder, and the squeegee holder having a fastening plate for fastening the squeegee holder on the receiving surface in a printing position in which the scraping direction of the squeegee extends along a direction of printing, and an alternative fastening plate for fastening the same squeegee holder on the receiving surface in an alternative printing position in which the scraping direction of the squeegee extends along an alternative direction of printing that is distinct from the direction of printing.

According to particular embodiments, the device includes one or more of the following characteristic features, considered in isolation or in accordance with all technically possible combinations:

the alternative fastening plate is substantially orthogonal to the fastening plate the alternative fastening plate and the fastening plate are located relative to each other in a manner so as to form a "T";

the support comprises the fastening members for fastening the squeegee holder that are capable of selectively clamping the fastening plate and the alternative fastening plate against the receiving surface;

the fastening members for fastening the squeegee holder comprise knob screws;

at least one of the knob screws is mounted so as to be pivotable about an axis substantially parallel to the receiving surface, and is capable of selectively engaging into a notch located on an edge of the fastening plate opposite to the screen and into a notch located on an edge of the alternative fastening plate opposite to the screen;

another one of the knob screws projects out from the receiving surface in the direction of the squeegee holder and is capable of selectively engaging into a notch located on an edge of the fastening plate located on the side of the screen and into a notch located on an edge of the alternative fastening plate located on the side of the screen;

the squeegee holder further comprises a squeegee holder assembly that is movable relative to both the fastening plate and the alternative fastening plate, and an actuator for moving the squeegee holder assembly relative to both the fastening plate and the alternative fastening plate along the direction of scraping;

the squeegee holder includes an actuator for lowering and raising the squeegee transversely to the direction of scraping.

BRIEF DESCRIPTION OF THE DRAWINGS

The invention will be better understood upon reading the description which follows, given by way of example, and with reference made to the accompanying drawings, in which.

DESCRIPTION OF EMBODIMENTS

With reference to FIGS. 1 to 5, the illustrations describe a device 1 according to the invention for printing an impression by silk screen printing on an object 3.

A direction of printing Ox, or longitudinal direction, and an alternative direction of printing Oy, or transverse direction are defined. The direction of printing Ox and the alternative direction of printing Oy are horizontal, and are for example, perpendicular to each other. A direction Oz is also defined, with Ox, Oy, Oz being direct references.

Figure 1:
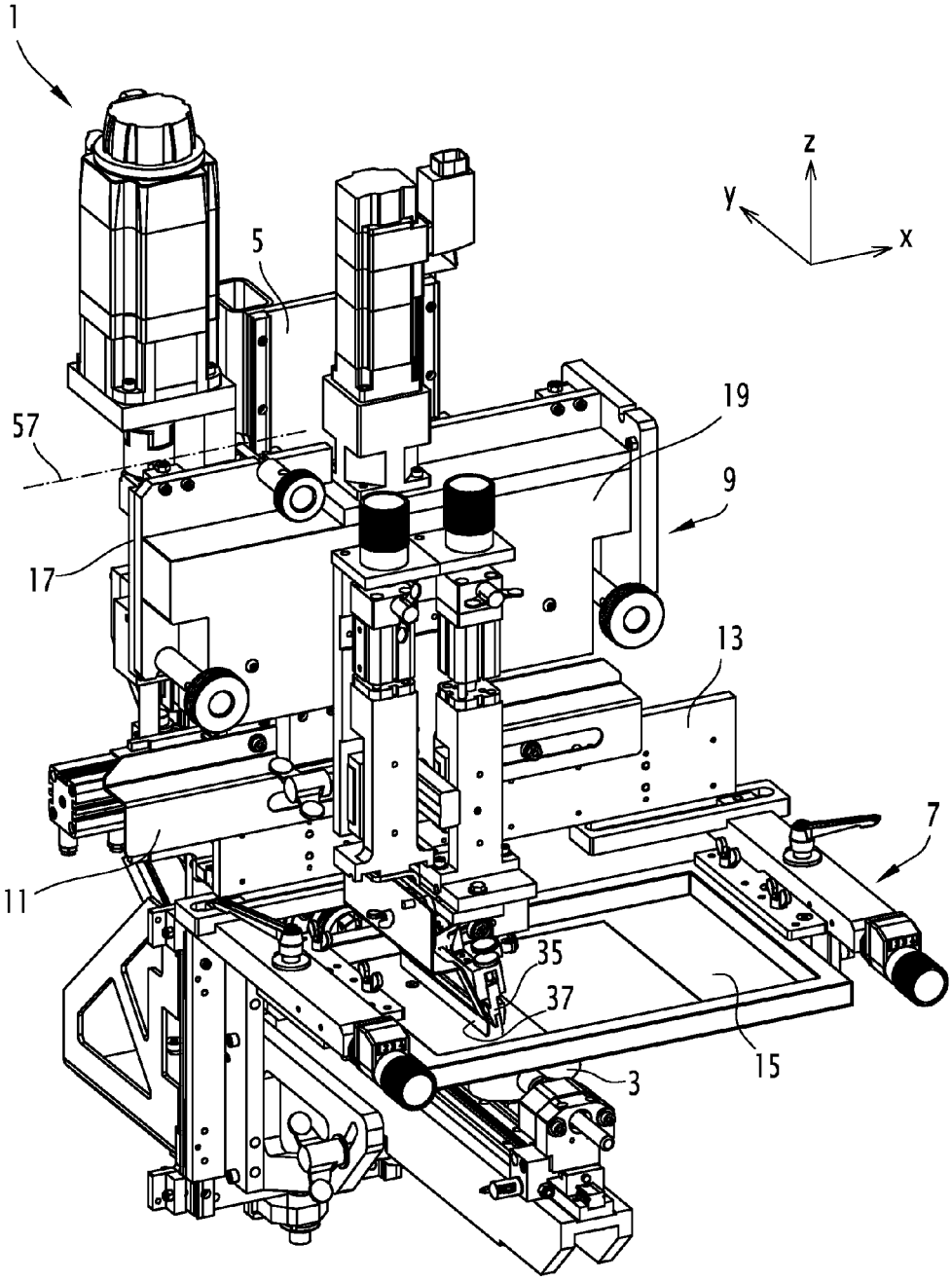
FIG. 1 is a perspective view of a device according to the invention, the squeegee holder being in a printing position.

The object 3 is for example a glass bottle, having a generally cylindrical shape. The object 3 is flat in the direction Oy, that is to say, that it has a rectilinear generatrix in this direction Oy As shown in FIG. 1, the device 1 comprises of a chassis 5, a screen holder module 7 and a squeegee holder module 9 mounted so as to be movable on the chassis 5.

The screen holder module 7 comprises a support 11, an adjustable screen holder 13, and a screen 15 held by the screen holder 13.

The adjustable screen holder 13 is mounted on the support 11 so as to be movable in translational motion substantially in the direction of printing Ox.

The screen 15 is advantageously rectangular. For example, the sides of the screen 15 are substantially parallel respectively to the directions Ox and Oy.

Figure 2:
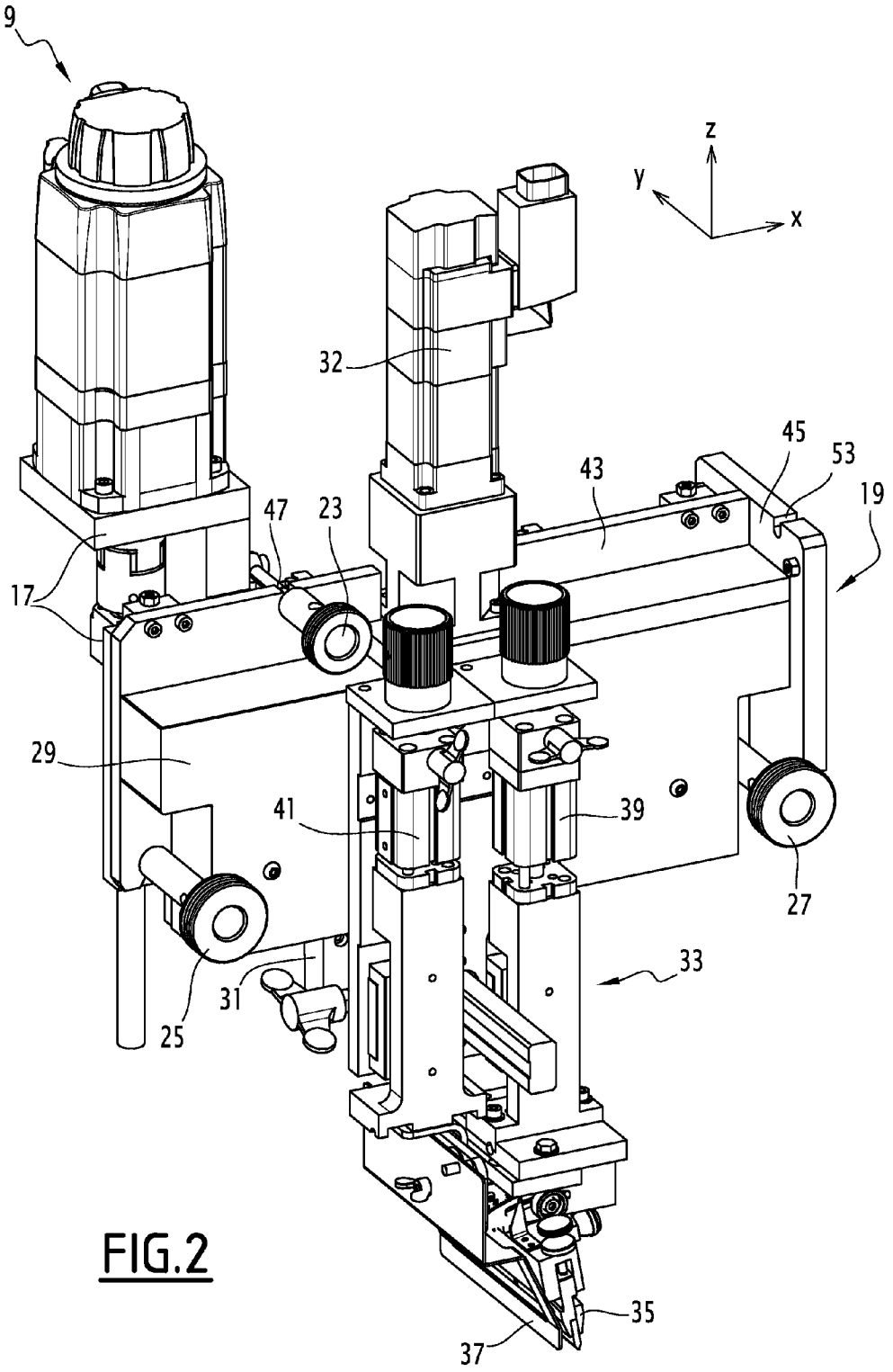
FIG. 2 is a detailed view of the device represented in FIG. 1, showing the squeegee holder module.
Figure 3:
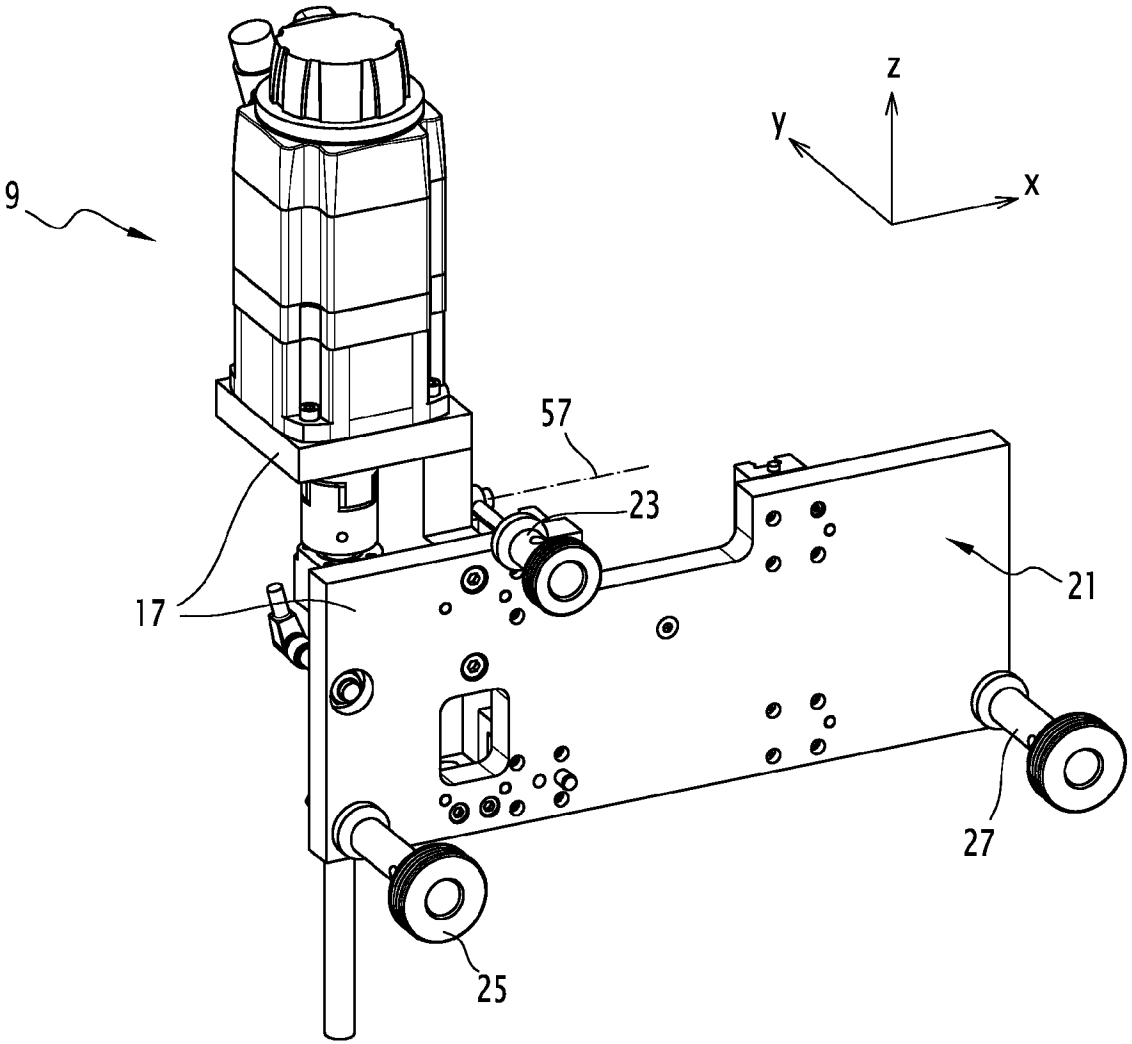
FIG. 3 is a perspective view of a part of the squeegee holder module, showing the support of the squeegee holder module without the squeegee holder.

As shown in FIGS. 1 and 2, the squeegee holder module 9 comprises of a rigid support 17 mounted so as to be slidable on the chassis 5, and a squeegee holder 19 fixed on to the support 17.

The screen holder module 7 and the support 17 are attached to each other possibly based on an adjustable arrangement.

The support 17 (FIG. 3) has a receiving surface 21 for receiving the squeegee holder 19 and the fastening members 23, 25, 27 for fastening the squeegee holder 19 on to the receiving surface 21.

Figure 6:
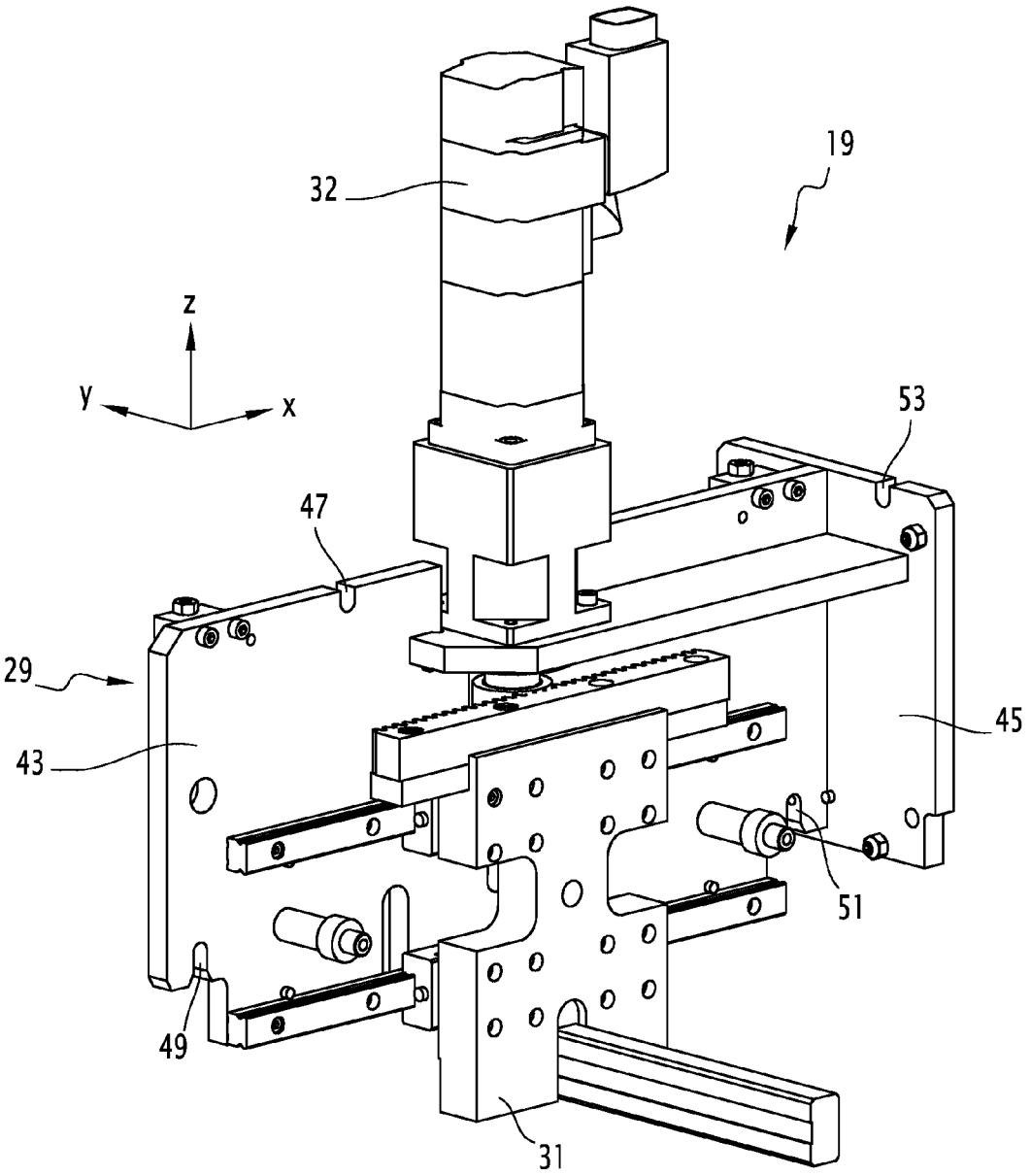
FIG. 6 is a perspective view of a part of the squeegee holder.

The squeegee holder 19 (FIGS. 2 and 6) comprises of a frame 29 and a carriage 31 mounted so as to be movable on the frame 29 in translational motion substantially along a direction of scraping. The squeegee holder 19 further comprises of an actuator 32 for moving the carriage 31 in translational motion relative to the frame 29 substantially along the direction of scraping, and a squeegee holder assembly 33 fixed on to the carriage 31.

The squeegee holder assembly 33 comprises of a squeegee 35, a counter squeegee 37 designed to bring back the ink by sweeping over the screen 15, an actuator 39 for lowering and raising the squeegee 35 respectively towards and away from the screen 15, and an actuator 41 for lowering and raising the counter squeegee 37 respectively towards and away from the screen 15.

The actuators 39, 41 are, for example pneumatic cylinders.

The frame 29 comprises of a fastening plate 43 for fastening the support 17 on to the receiving surface 21, and an alternative fastening plate 45 for fastening the support 17 on to the receiving surface 21. These two plates extend perpendicularly to each other along two planes intersecting along a line parallel to the direction Oz.

The fastening plate 43 has an upper notch 47 intended for cooperating with the fastening member 23, and two lower notches 49, 51 intended for cooperating with the fastening members 25, 27.

The alternative fastening plate 45 forms a "T" with the fastening plate 43 along the direction Oz. The plate 43 extends parallelly to the scraping direction of the carriage 31 while the alternative fastening plate 45 extends perpendicularly to the said direction of scraping.

The alternative fastening plate 45 has an upper notch 53 intended for cooperating with the fastening member 23, and a lower notch 55 (FIG. 5) intended for cooperating with the fastening member 25.

The fastening members 23, 25, 27 are for example knob screws.

The screws 25 and 27 are located on the bottom part of the support 17. The screws 25 and 27 project out from the receiving surface 21, substantially along the direction Oy towards the squeegee holder 19.

The screw 23 is mounted so as to be pivotable on the support 17 about an axis 57 substantially parallel to the direction of printing Ox. The screw 23 is movable between a raised position (not shown) in which it is at a distance from the receiving surface 21, and a lowered position (FIG. 3) in which it is selectively engaged in one of the upper notches 47 (FIG. 2) and 53 (FIG. 4).

In FIGS. 1 and 2, the squeegee holder 19 is in a printing position in which the fastening plate 43 is secured on to the support 17.

Figure 4:
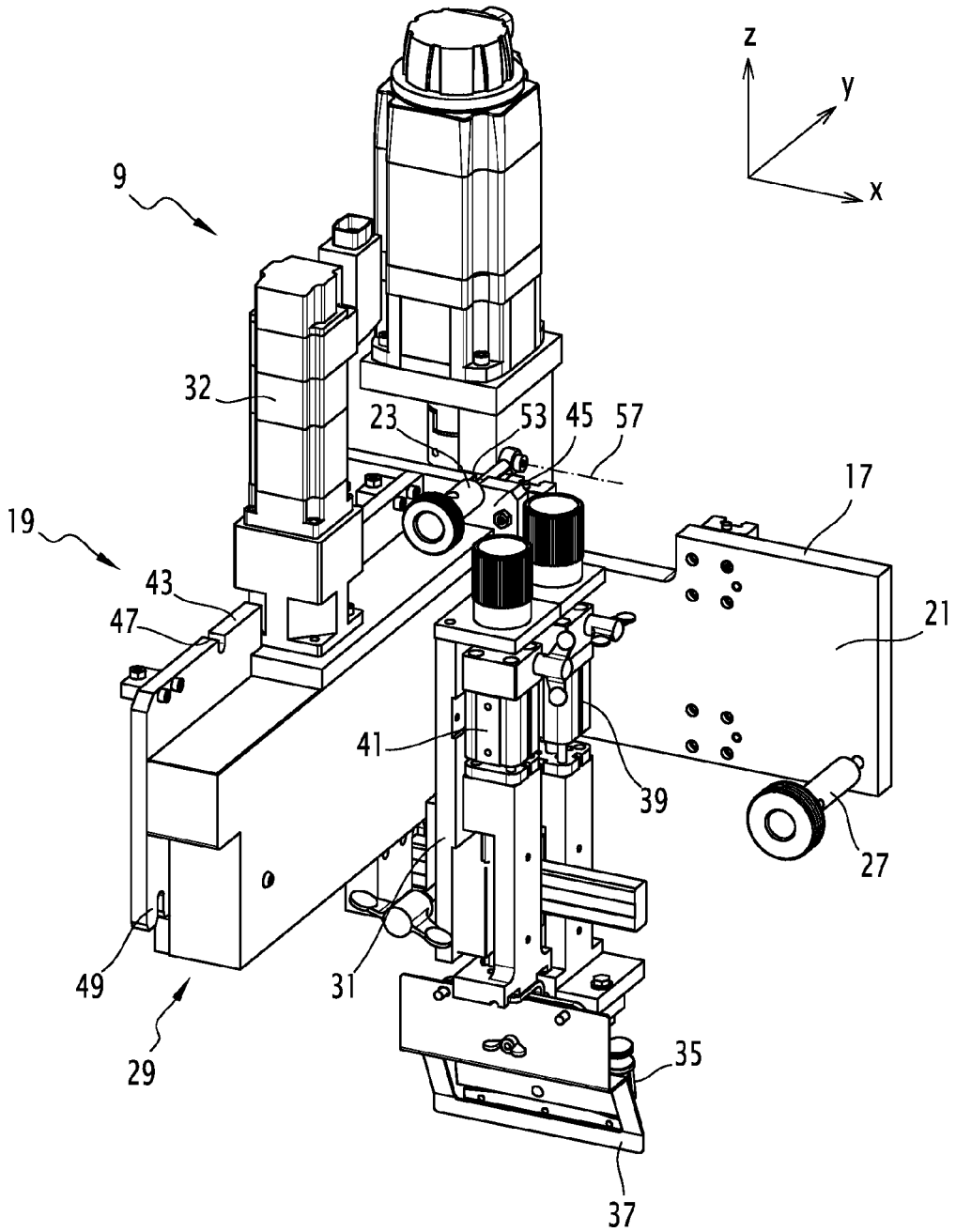
FIGS. 4 and 5 are perspective views of the squeegee holder module, the squeegee holder being in the alternative printing position.
Figure 5:
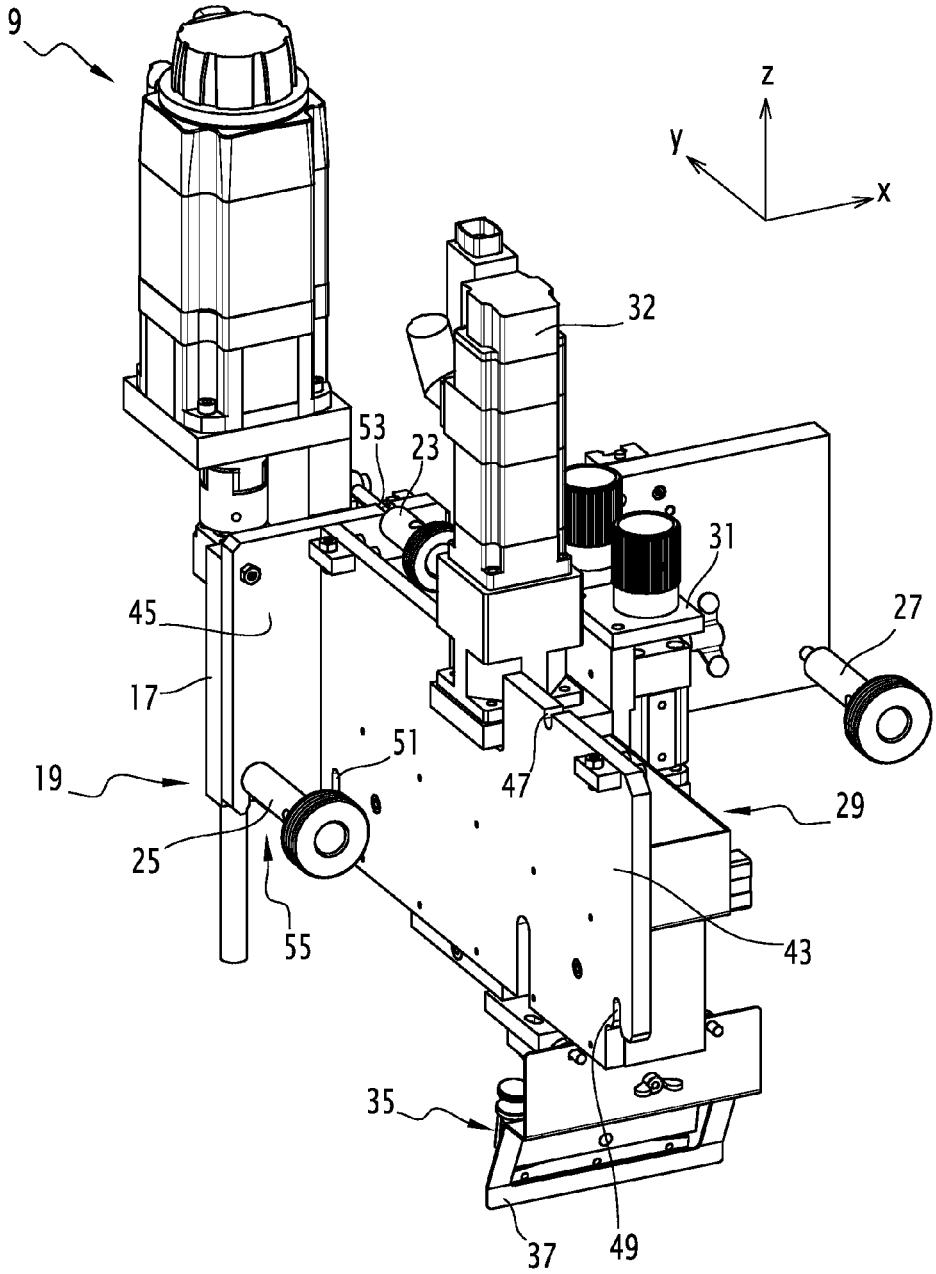

In FIGS. 4 and 5, the squeegee holder 19 is in an alternative printing position in which the alternative fastening plate 45 is secured on to the support 17.

The operation of the device 1 will now be described.

When the squeegee holder 19 is in the printing position (FIGS. 1 and 2), the fastening plate 43 rests on the screws 25, 27 by means of the notches 49, 51. The screw 23, in the lowered position, is engaged in the notch 47. The screws 23, 25, 27 are tightened against the fastening plate 43.

The actuator 32 moves the carriage 31 relative to the frame 29. This moves the squeegee 35 along the direction of printing Ox, the scraping direction of the carriage being parallel to the direction of printing Ox.

In order to make the shift from the printing position to the alternative printing position, it is necessary to slightly unscrew the screws 23, 25, 27. The screws 25, 27 continue to support the fastening plate 43. Then the screw 23 is raised from the lowered position to the raised position. This releases the fastening plate 43. The squeegee holder 19 is then lifted, rotated at 90° about the axis Oz and the alternative fastening plate 45 is fixed on to the support 17.

In order to do this, the alternative fastening plate 45 is pressed against the receiving surface 21, and moved towards the bottom. The notch 55 comes to be positioned over the screw 25 (FIG. 5). The screw 25 supports the squeegee holder 19, while the screw 23 is moved from the raised position to the lowered position and gets engaged into the notch 53. The alternative fastening plate 45 is then held in place by the screws 23 and 25. The screws 23 and 25 are then tightened against the alternative fastening plate 45.

The actuator 32 moves the carriage 31 relative to the frame 29 perpendicularly to the plate 45. Thus, the squeegee 35 moves along the alternative direction of printing Oy.

Bringing about the shift from the alternative printing position to the printing position takes place in a manner analogous to that of bringing about the shift from the printing position to the alternative printing position and will not be described.

Thanks to the characteristic features described here above, the squeegee holder 19 is easily placed selectively in the printing position and in the alternative printing position, without the settings of the position of the squeegee holder 19 relative to the chassis 5 being altered. The device 1 therefore enables the rapid changing of the direction in which the scraping takes place, while at the same time retaining the settings of the position of the squeegee holder 19 relative to the chassis 5.

Furthermore, the actuator 32 of the squeegee 35 forming part of the squeegee holder 19, the internal settings of the position of the squeegee along the direction of printing relative to the squeegee holder are not altered by the changing of the printing position to the alternative printing position.

In the same way, the actuator 39 35 of the squeegee forming part of the squeegee holder 19, the internal settings of the position of the squeegee transversely to the direction of printing relative to the squeegee holder are not altered by the changing of the printing position to the alternative printing position.

The invention claimed is:

1. A device for printing an impression by silk screen printing on at least one object, of the type comprising of:

a chassis;

a screen holder module mounted on the chassis for holding a screen; and a squeegee holder module mounted on the chassis for holding a squeegee that is designed for scraping over the screen along a direction of scraping, wherein the squeegee holder module comprises a support mounted on the chassis, and a removable squeegee holder attached on the support, the support having a receiving surface for receiving the squeegee holder, and the squeegee holder having a fastening plate for fastening the squeegee holder on the receiving surface in a printing position in which the scraping direction of the squeegee extends along a direction of printing, and an alternative fastening plate for fastening the same squeegee holder on the receiving surface in an alternative printing position in which the scraping direction of the squeegee extends along an alternative direction of printing that is distinct and separate from the direction of printing.

2. A device according to claim 1, wherein the alternative fastening plate is substantially orthogonal to the fastening plate.

3. A device according to claim 2, wherein the alternative fastening plate and the fastening plate are located relative to each other in a manner so as to form a "T".

4. A device according to claim 1, wherein the support comprises fastening members for fastening the squeegee holder that are capable of selectively clamping the fastening plate and the alternative fastening plate against the receiving surface.

5. A device according to claim 4, wherein the fastening members for fastening the squeegee holder comprise knob screws.

6. A device according to claim 5, wherein at least one of the knob screws is mounted so as to be pivotable about an axis substantially parallel to the receiving surface, and is capable of selectively engaging into a notch located on an edge of the fastening plate opposite to the screen and into a notch located on an edge of the alternative fastening plate opposite to the screen.

7. A device according to claim 6, wherein another one of the knob screws projects out from the receiving surface in the direction of the squeegee holder and is capable of selectively engaging into a notch located on an edge of the fastening plate located on the side of the screen and into a notch located on an edge of the alternative fastening plate located on the side of the screen.

8. A device according to claim 1, wherein the squeegee holder further comprises a squeegee holder assembly that is movable relative to both the fastening plate and the alternative fastening plate, and an actuator for moving the squeegee holder assembly relative to both the fastening plate and the alternative fastening plate along the direction of scraping.

9. A device according to claim 1, wherein the squeegee holder includes an actuator for lowering and raising the squeegee transversely to the direction of scraping.

* * * * *